US005327849A

United States Patent [19]

Miller

[11] Patent Number: 5,327,849

[45] Date of Patent: Jul. 12, 1994

[54] UNDERWATER BREATHING APPARATUS

[75] Inventor: Harry R. Miller, Trumansburg, N.Y.

[73] Assignee: Keene Engineering, Inc., Northridge, Calif.

[21] Appl. No.: 108,337

[22] Filed: Aug. 18, 1993

[51] Int. Cl.[5] ..... B63C 11/46

[52] U.S. Cl. ..... 114/315; 128/201.27; 128/202.14; 405/186

[58] Field of Search ..... 441/1; 114/315; 405/186; 128/201.11, 201.27, 202.14

[56] References Cited

U.S. PATENT DOCUMENTS

| | | | |
|---|---|---|---|
| 2,593,988 | 4/1952 | Cousteau | 128/144 |
| 3,400,680 | 9/1968 | Taylor . | |
| 3,630,165 | 12/1971 | Bottger | 114/315 |
| 3,757,719 | 9/1973 | Strickland | 114/315 |
| 3,795,213 | 3/1974 | Strickland | 114/315 |
| 4,276,851 | 7/1981 | Coleman | 114/315 |
| 4,288,176 | 9/1981 | Devine | 114/315 |
| 4,348,976 | 9/1982 | Gilbert | 114/315 |
| 4,674,493 | 6/1987 | Mitchell . | |

*Primary Examiner*—Stephen P. Avila

*Attorney, Agent, or Firm*—Barnard, Brown & Michaels

[57] ABSTRACT

A floating apparatus for providing pressurized air to a submerged swimmer. A floatation device supports a combination of two containers above the surface of the water. The top container, in the form of an inverted box, holds one or more electrically powered compressors. The bottom container holds a battery for powering the compressors. Water ingestion by the compressor(s) is prevented by placing the air intake inside the upper box, which forms an air trap. The air intake and compressors are isolated from any possible contamination or explosion risk from the battery outgassing, which is safely vented to the outside air from the lower compartment. Battery life is extended by pressure switch controls on the air compressor(s), running them on demand instead of continuously.

6 Claims, 2 Drawing Sheets

UNDERWATER BREATHING APPARATUS

FIELD OF THE INVENTION

The invention pertains to the field of apparatus for supplying air to divers underwater. More particularly, the invention pertains to floating air compressors used for supplying surface air under pressure to divers.

BACKGROUND OF THE INVENTION

The present invention relates to apparatus for pumping air to a submerged diver.

Many types of apparatus have been designed to allow a swimmer to breathe underwater. The simplest, a snorkel, is simply a tube which extends from the swimmer's mouth to the surface. The disadvantage of the snorkel is that a swimmer would have to hold his breath to go any deeper than the surface of the water. Extended snorkels, with the upper end supported by a float on the surface of the water, have been tried. However, as the diver gets deeper and the water pressure gets higher, the tube becomes of less and less use. Finally, at a relatively shallow depth, the diver can no longer breathe through the tube.

Perhaps the earliest method of supplying air for a diver to breathe underwater is to have a pump located above the water's surface on a boat or dock. Air is then supplied through a hose and may simply be fed into a pressurized suit worn by such divers for deep sea diving. While this allowed extended diving, the heavy suits and thick tubing required did not permit free diving, and required a crew on the surface to tend the compressor (and, in the earliest versions, to actually operate the pump by hand).

The limitations of the "hard hat" diving suit were largely allieviated by the "SCUBA" (Self-Contained Underwater Breathing Apparatus) developed by Jacques Cousteau in the early 1950's (see Cousteau, U.S. Pat. No. 2,593,988). A pressurized tank of air is worn by the diver on his back. The air pressure is regulated according to the demand and depth and is supplied to the diver through a hose and mouthpiece. The diver can swim freely and breathe at depths below the surface with tank pressure sufficient to compensate for water pressure at a particular depth. However, there is extensive training required for such a device, and the time underwater is strictly limited by the capacity of the air tanks.

In an attempt to combine the advantages of SCUBA and surface-supply systems, while maintaining the ability to swim more-or-less freely, a number of products have been developed which float independently on the surface of the water and pump air to a submerged swimmer. Typically such a device consists of an air compressor powered by a gasoline engine mounted on a floatation device such as a large inner tube or raft. The diver is supplied with air through a float tube. Such a device is currently being sold by Keene Engineering of Northridge, Calif. (see page 27, "Model 263GH Mounted on a Tote Float", Spring 1993 catalog).

Although the air supply can be isolated from the engine to some degree, there are risks of contamination of the air from exhaust of the gasoline engine. To avoid this risk, some inventors have used electric motors to power the compressor. For example, see Taylor, U.S. Pat. No. 3,400,680. The present inventor has previously invented and sold a solar-powered floating air compressor system, which was the subject of U.S. patent application No. 06/804,444, filed Dec. 4, 1985, now abandoned.

Electrically powered compressors are cleaner but they produce an electrical arc at the armature of their motor. This arc is potentially dangerous and gases including hydrogen from the battery can cause safety problems. Mitchell, U.S. Pat. No. 4,674,693 is an example of a floating compressor in which the battery and motor are enclosed in a sealed compartment, which would present the risk of ignition of the battery outgassing by any sparks from the motor.

As with the examples cited above, all of the electric-compressor diving devices known to the inventor are designed using one compressor, which leaves no back up air supply in case of mechanical failure.

In addition, the battery life of electric compressors is limited by the fact that the compressor in all prior art devices runs continuously.

Also, although various devices have used various schemes for avoiding water intake into the compressor (such as the snorkel used by Mitchell), such methods have met with limited success. The spray and wave action common in most open water situations lead to water ingestion in any system using open air intakes.

There is a need for a small, floating, electrically powered diving device that is clean, mechanically and chemically safe, with an automatic on demand air supply to conserve battery power while the diver is not breathing.

SUMMARY OF THE INVENTION

The present invention is a floating apparatus for providing pressurized air to a submerged swimmer. A floatation device supports a combination of two containers above the surface of the water. The top container, in the form of an inverted box, holds one or more electrically powered compressors. The bottom container holds a battery for powering the compressors.

Water ingestion by the compressor(s) is prevented by placing the air intake inside the upper box, which forms an air trap. The air intake and compressors are isolated from any possible contamination or explosion risk from the battery outgassing, which is safely vented to the outside air from the lower compartment.

Battery life is extended by pressure switch controls on the air compressor(s), running them on demand instead of continuously.

DESCRIPTION OF THE PREFERRED EMBODIMENT

Figure 1:
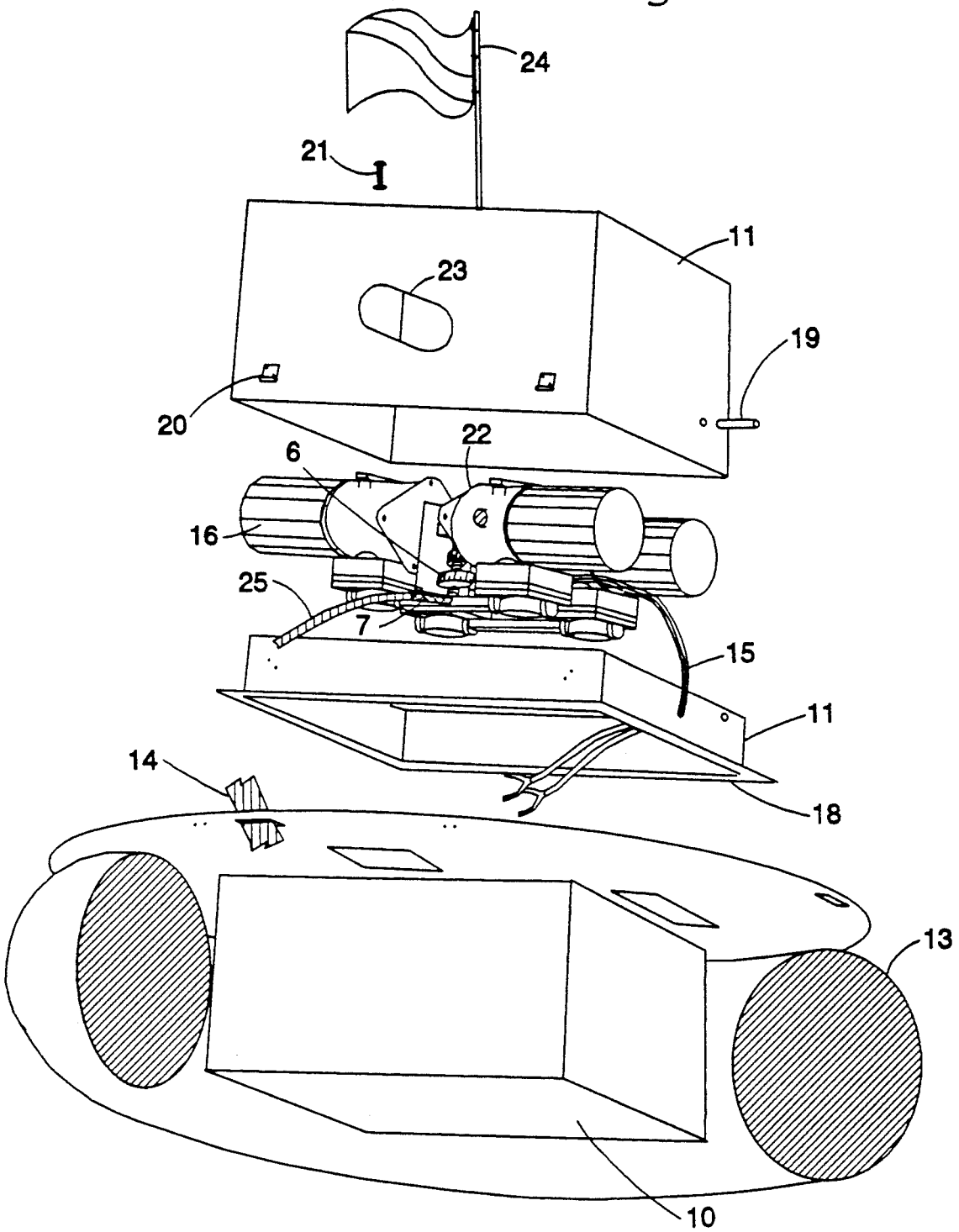
FIG. 1 shows an underwater breathing device according to the preferred embodiment of the present invention.

Referring to FIG. 1, the preferred embodiment of the invention is housed in a two part (10), (11) container fastened to a flotation device (13). A diver's flag (24) may be secured to top half (11) as shown. Air is supplied to submerged divers through an air line (25) which is preferably connected to the invention by an air chuck (7). More than one air line is possible within the teachings of the invention, with proper choice of compressor(s) and depth of operation. The air supply is regulated to the diver's demand by use of a conventional diver's mouthpiece/regulator (not shown).

The top (11) and bottom (10) halves or compartments of the container are fastened together with the battery below and the compressor container on top. This arrangement gives a center of gravity below the center of the floatation device (13) allowing the apparatus to float with stability on the water's surface. The unit is easily disassembled to top (11), bottom (10) and floatation device (13) for carrying and storage.

The container is mounted to the floatation device (13) by securing straps (14). The floatation device may be any of the many means of supporting a weight on the surface of the water known to the art, such as rigid metal or plastic floats, styrofoam, or inflatable floats. The preferred embodiment of the invention uses an inflatable tube, such as a large "ski tube" with a nylon cover, widely available from recreational boating suppliers and others.

The top half (11) of the housing is preferably secured to the bottom half (10) by means of snap apart hinges (20), allowing easy access to both compartments.

One or more electrical compressors (16) are located in the top half (11) and secured by screws (21). Multiple compressors are preferable, with the outlets paralleled in a modular configuration, providing additional safety in the form of backup in case of mechanical failure, and additional air volume capacity. The invention is preferably designed to be upgraded in a modular fashion by adding additional compressors in single or paired configurations.

The compressors are preferably 12-volt DC powered compressors, which can be easily powered by readily available batteries. 6- or 24-volt compressors are also available, with appropriate changes in battery configurations. The compressor used in the preferred embodiment of the invention is available from Keene Engineering as number EAT-30. Each compressor should have a total air volume output of at least 1 cu. ft./min, at a minimum pressure of 30 psi. to assure adequate output to depths of 20 feet. With additional compressors added in parallel, additional depths of up to 75 feet or additional divers at lesser depths can be supplied. As used in the preferred embodiment of the invention, two pairs of model EAT-30 compressors will supply a single diver at depths of up to 75 feet.

The upper compartment is in the form of an inverted box, with no openings above approximately the midline. This closed area forms a natural air trap, immune from wave and spray. Air vents (23) are provided below this point, and may be used as hand holds for transporting the device. The air intakes of the compressors (22) are located above the air vents (23), drawing upon the clean air trapped by the air trap. Thus, water ingestion is prevented, even in the roughest water or spray conditions.

The running of compressors (16) is preferably controlled by pressure switches (6) to maximize battery life. When air is not in demand the unit will turn off automatically. When air is in demand the unit will turn on automatically. Although it is possible to include a surge tank in the design to act as reserve and minimize cycling of the compressor(s), the preferred embodiment does not need or use one, as the length of pressure hose itself acts as a reservoir. The compressor(s) supply air to the hose, pressurizing it to a given pressure, preferably 75 psi, and then cutting out under the control of the pressure switch (6). As the air is breathed by the diver, the pressure drops to 50 psi, at which point the compressors are restarted.

If desired, more than one pressure switch may be used, preferably one switch per module of one or two compressors. This minimizes the current through any switch (for longer switch life) and provides backup in case of failure of a switch. The same effect may be obtained by using pressure switches with multiple contacts (i.e. DPST), and paralleling the contacts. The pressure switch can easily be chosen by one skilled in the art, based upon the amperage of the contacts, the draw of the compressor(s), and the pressure range required. The model EASPS1 pressure switch, available from Keene Engineering, is used in the preferred embodiment. It has a pressure range of 30 to 100 psi, and contacts rated at 25 amps.

The lower container has a sealed top and bottom with a means for venting hydrogen gas and other potentially dangerous gases away from the electrically powered compressors. A battery is mounted in the lower half (10) and supplies power through a wire assembly (15) to the compressors (16) located in the top half (11). The bottom compartment is sealed by a battery cover which is mounted inside the top half (11). Battery cover (17) has a seal (18) affixed to the cover's mating surface. Harmful gases produced in the lower half (10) are vented through vent tube (19). The battery used in the preferred embodiment is a Voyager model manufactured by Delco, which has a capacity of 620 cold crank amps, which is sufficient for a duration of 4 hours of diving. The battery charge life will vary, of course, based upon the depth of dive, number of divers and individual differences.

The use of electrically powered compressors eliminates the risk of fumes caused by gasoline driven compressors. The use of a sealed and vented battery container separate from the electric compressors eliminates the potential intake or explosion of harmful gases from battery chemical reactions.

Figure 2:
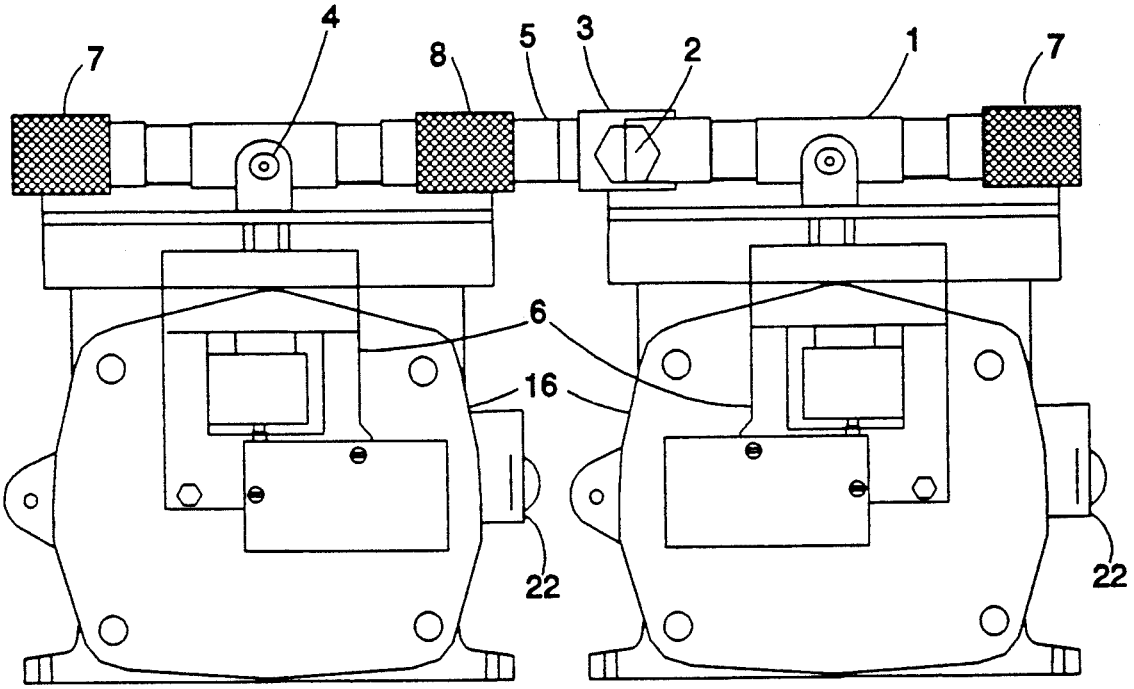
FIG. 2 shows a detail of the compressor design of the preferred embodiment of the invention.

FIG. 2 shows the details of the modular compressor design as used in the preferred embodiment of the invention. Compressors (16) may be joined in a modular fashion by joining air chucks (5) & (8), adding capacity to unit.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

I claim:

1. A floating apparatus for providing pressurized air to a submerged swimmer comprising:

a) flotation means for supporting the apparatus on the surface of the water;

b) compressor housing means mounted on the floatation means, comprising an air trap in the form of an inverted chamber comprising a plurality of sides and a top sealably attached to the sides, a plurality of air vents in the sides of the air trap, below the midline thereof, such that the air in the air trap is uncontaminated by waves or spray, and mounting means for mounting one or more compressors attached to the air trap;

c) battery housing means mounted to the floatation means adjacent to, but not in gas communication with, the compressor housing means, comprising a compartment suitable for housing at least one battery, mounting means for mounting the battery inside the battery housing means, and vent means for venting battery gasses from the inside of the battery housing means to the open air, in a location removed from the air vents of the compressor housing means;

d) at least one battery, mounted to the mounting means of the battery housing means;

e) at least one electric compressor, mounted to the mounting means of the compressor housing means, electrically connected to a battery in the battery compartment means, having an air inlet in the air trap portion of the compressor housing means, such that the air compressed is not contaminated by water or spray, and an air outlet adapted to supplying air to a submerged diver.

2. The floating apparatus of claim 1, in which there is more than one compressor.

3. The floating apparatus of claim 2, in which the compressors may be added to the device in a modular fashion by connecting the air outlets together.

4. The floating apparatus of claim 1 further comprising at least one pressure switch having a pressure sensor input connected to the air outlet, and an electrical input and an electrical output operatively controlled by the pressure sensor such that the electrical input is connected to the electrical output when the air pressure at the pressure sensor input is below a first preselected value, and the electrical input is disconnected from the electrical output when the air pressure at the pressure sensor input is above a second preselected value, the electrical input being connected to the battery and the electrical output being connected to the compressor, whereby the compressor is controlled by the pressure at the air outlet.

5. The floating apparatus of claim 4 in which there are a plurality of pressure switches in parallel.

6. The floating apparatus of claim 5 in which there is one pressure switch for each compressor.

* * * * *